United States Patent [19]

Leach

[11] 4,319,212

[45] Mar. 9, 1982

[54] FUSE SUPPORTING MEANS HAVING NOTCHES CONTAINING A GAS EVOLVING MATERIAL

[75] Inventor: John G. Leach, Hickory, N.C.

[73] Assignee: General Electric Company, Philadelphia, Pa.

[21] Appl. No.: 251,641

[22] Filed: Apr. 6, 1981

[51] Int. Cl.[3] ..... H01H 85/04

[52] U.S. Cl. ..... 337/159; 337/290; 337/227

[58] Field of Search ..... 337/158, 159, 273, 276, 337/290, 295, 297, 227

[56] References Cited

U.S. PATENT DOCUMENTS

| | | | |
|---|---|---|---|
| 3,243,552 | 3/1966 | Mikulecky | 337/276 X |
| 3,287,525 | 11/1966 | Mikulecky | 337/276 X |
| 3,294,936 | 12/1966 | Mikulecky | 337/159 |
| 3,304,388 | 2/1967 | Lindell | 337/273 X |
| 3,437,971 | 4/1969 | Mikulecky | 337/227 X |
| 3,755,769 | 8/1973 | Mikulecky | 337/158 |
| 3,983,524 | 9/1976 | Koch | 337/159 |

*Primary Examiner*—George Harris

*Attorney, Agent, or Firm*—William Freedman; John P. McMahon

[57] ABSTRACT

A high voltage fuse comprised of a fuse element wrapped about a core, enclosed in a housing member, and surrounded by a granular quartz material is disclosed. The core has a plurality of cutouts along its outer surfaces having preselected dimensions relative to the width of a fuse element of such values as to assure that at least one cutout is interposed between adjacent turns of the fuse element. The interposed cutouts increase the creepage between the adjacent turns of the fuse element. The preselected dimensions of the cutouts relative to fuse-element width provide a single core that is capable of accommodating numerous types and different numbers of fuse elements. The core is also provided with a gas evolving material attached to the cutouts and separated from the fuse element by a predetermined amount to provide controlled release of arc-quenching gas, when arcing inside the fuse occurs.

4 Claims, 3 Drawing Figures

$E_W > w$ (1)

$E_S \geq C + w$ (2)

FUSE SUPPORTING MEANS HAVING NOTCHES CONTAINING A GAS EVOLVING MATERIAL

BACKGROUND OF THE INVENTION

This invention relates to a high voltage fuse and, more particularly, to a fuse core having a fuse element wrapped about it and constructed to provide increased creepage between adjacent turns of the fuse element and also to provide improved performance of the high voltage fuse.

High voltage fuses conventionally comprise a fusible element embedded in a granular inert material of high dielectric strength such as sand or finely divided quartz. The fusible element may be in the form of a ribbon type silver material which is wound on a supporting core. When subjected to currents of fault magnitude, the fusible element attains a fusing temperature and vaporizes, whereby arcing occurs and the metal vapors rapidly expand to many times the volume originally occupied by the fusible element. The metal vapors are thrown into spaces between the granules of the inert filler material where they condense and are no longer available for current conduction. The current limiting effect results from the introduction of arc resistance into the circuit. The physical contact between the hot arc and the relatively cool granules causes a rapid transfer of heat from the arc to the granules, thereby dissipating most of the arc energy with very little pressure built up within the fuse enclosure.

The core may be provided with angularly-spaced raised fins extending longitudinally of the core along its outer surfaces. The fuse elements having the form of a plurality of silver wires or ribbon may be wrapped in a helical manner along the fins. Such various type cores are described in U.S. Pat. Nos. 3,243,552; 3,294,936 and 3,437,971, issued to H. W. Mikulecky, Mar. 29, 1966, Dec. 27, 1966 and Apr. 8, 1969, respectively. In these patents the fins are provided with cutouts which have the effect of improving insulation between the adjacent turns of the fuse elements. In the fuses shown in these patents, the cutouts are generally large in relation to the fuse element width, and this, as well as other dimensional relationships, makes it generally necessary to use different core designs for different element numbers and/or winding angles.

The aforesaid U.S. Pat. Nos. 3,243,552; 3,294,936; and 3,437,971 also describe a supporting core of insulating material positioned in contact with the fusible element that is adapted to evolve a gas in the presence of an arc. The gas evolving material provides a de-ionizing action that reduces the occurrence of restriking, that is, the occurrence of fuse conduction after the interruption of the transient overload current. The core typically has a high thermal conductivity characteristic that conducts heat away from the fuse element during an overcurrent condition. The cooling effect of the core reduces the available heat to melt the fuse element and thereby reduces the consistency of performance of the high voltage fuse.

Accordingly, an object of my invention is to provide a core which is capable of accommodating fuse elements with various winding angles and in various numbers and yet which always has between adjacent turns the increased creepage distance provided by at least one cutout.

A further object of my invention is to reduce the cooling effect of the supporting core and correspondingly improve the consistency of performance of the high voltage fuse.

These and other objects of the present invention will become apparent to those skilled in the art upon consideration of the following description of the invention.

SUMMARY OF THE INVENTION

In accordance with this invention a high voltage fuse of the current limiting type having a tubular insulating casing and an inert granular material of high dielectric strength within the casing is provided. The high voltage fuse further comprises a core within the tubular casing extending longitudinally thereof, and one or more ribbon-type fuse elements of predetermined width wrapped around the core and having turns spaced apart along the length of the core. The core has a plurality of angularly-spaced fin members disposed about its center and extending longitudinally of the core. The plurality of fin members have a plurality of cutouts located on their outer surface so as to increase the outer surface area of the core. The cutouts have a predetermined width with immediately-adjacent cutouts being spaced apart from each other by a predetermined amount. The predetermined width of the cutout being less than the predetermined width of the fuse element. The predetermined width of the cutout and the predetermined amount of spacing between immediately-adjacent cutouts have a combined longitudinal distance along the outer surface of the associated fin member which is less than the distance along the fin member between adjacent turns of the fuse element or elements so that at least one of the cutouts is interposed between adjacent turns of the wrapped fuse element or elements, whereby the interposition of the cutout between the adjacent turns of the fuse element or elements improves the creepage between adjacent turns of the fuse element or elements.

The features of the invention believed to be novel are set forth with particularity in the appended claims. The invention, itself, however, both as to its operation and method of operation, together with further objects and advantages thereof, may be best understood by reference to the following description taken in conjunction with the accompanying drawings.

DESCRIPTION OF THE PREFERRED EMBODIMENT

Figure 1:
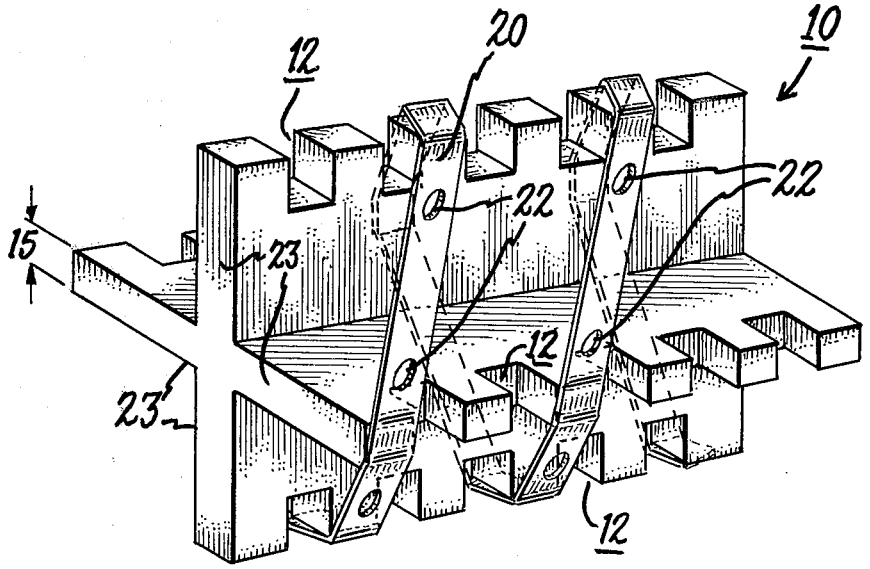
FIG. 1 is a perspective view of the core of the present invention having fuse elements wrapped about it.

FIG. 1 shows a core 10 of the present invention having wrapped around it a fuse element 20. It is to be understood that the core 10 and fuse element 20 are typically located within a tubular insulating housing having electrical terminals at its opposite ends and that the fuse element 20 provides an electric circuit between these terminals. Such housing and terminals are not shown in FIG. 1, but reference may be had to the aforesaid U.S. Patent 3,294,936 for such a showing. This latter patent is incorporated by reference in the present application.

While I have shown a single fuse element 20 wrapped about the core, it is to be understood that the invention also comprehends a fuse construction in which a plurality of fuse elements electrically connected in parallel are wrapped about the core and interconnect the terminals of the fuse.

The fuse element 20 is of a conventional type having a ribbon type form and of a high conductivity material such as silver having a melting temperature in the order of 1,760° F. The fuse element 20 has a plurality of circular perforations 22, spaced apart longitudinally thereof. The perforations 22 provide minimum cross sectional areas of fuse element 20 which under high fault conditions vaporize, resulting in the formation of arclets in series. This action causes progressive insertion of arc resistance into the circuit during the initial arcing period and thus limits the inductive voltage surges which may occur. The fuse element or element 20 are wound about core 10 in a desired pattern. The end portions of the fuse element or elements 20 are then affixed (not shown) at their final or terminal position to the terminals of the fuse.

The core 10 has a cross-like shape with substantially the same length in its upright and transverse directions. The arms of the cross, which are designated 23 and extend longitudinally of the core 20, are referred to herein as fin members. The cross-like shape is desirable in that it reduces the contact area between the fuse elements 20 and the core 10. Similarly, the core 10 may also have a star-like shape to reduce the contact area between the fuse element 20 and the core 10. As is well known, reducing the contact area between a core, such as core 10, and a fuse element, such as fuse element 20, improves the performance of the high voltage fuse. The core 10 is formed of a dielectric material such as ceramic or mica having a typical dielectric constant of 5. Each of the fin members 23 has an outer surface, as shown in FIG. 1, having a plurality of cutouts 12. For the sake of clarity, only one cutout per outer surface is designated in FIG. 1. Each of the cutouts 12 has a length that transverses the width 15 of the fin member 23 as shown in FIG. 1.

Figure 2:
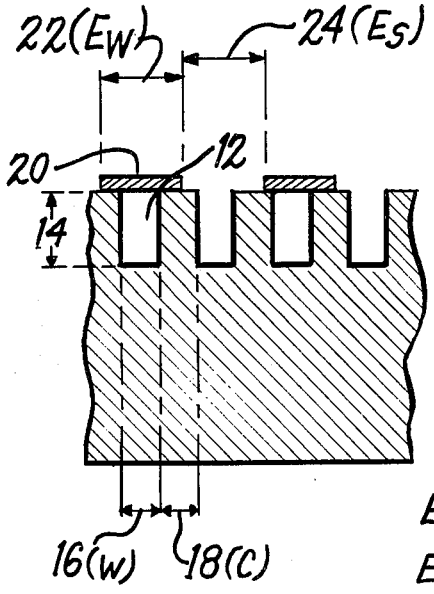
FIG. 2 is a cross sectional view of a portion of the core of FIG. 1 having adjacent sections of the fuse element positioned on its outer surface.

The cutouts 12, shown most clearly in FIG. 2, have a depth 14 extending into the outer surfaces of fin members 23 and have a width extending along the outer surface of fin member 23 by a distance 16 (W). Immediately adjacent cutouts 12 are spaced apart by a distance 18 (C). FIG. 2 further shows the fuse element 20 as having a width 22 (Ew) and a distance 24 (Es) between adjacent elements or turns of a single fuse element 20.

The dimensions of cutout 12 are selected relative to the dimension of the width 22 (Ew) of a fuse element 20. The desired dimensions are selected in accordance with the following two relationships:

$$Ew > W \quad (1)$$

$$Es \geqq C + W \quad (2)$$

wherein;

Ew = width of fuse element 20

W = width of cutouts 12

Es = distance between adjacent elements (20) or turns of a single fuse element 20

C = spacing between adjacent cutouts 12

As it is known, the dielectric breakdown along a solid surface of a core, such as core 10, formed of ceramic of mica like material, is typically less than that through a similar distance of fuse filler medium such as the granular quartz material. The dielectric breakdown between two points on the core may be improved by increasing the surface distance along core 10. Cutouts 12 are placed in the outer surface areas of fin members 23 of core 10 to increase the effective surface length of core 10 and therefore improve its dielectric breakdown characteristic. The cutouts 12 increase the surface distance between the locations at which the fin members are contacted by adjacent turns of the fuse element 20 so as to increase the voltage necessary to cause a dielectric breakdown between adjacent turns of the fuse element 20. As will be explained with reference to FIG. 3, the cutouts 12 interposed between adjacent turns of fuse element 20 may be filled with a granular quartz material 42 such as sand. The placement of a high dielectric fuse filler medium within cutouts 12 further increases the amount of voltage necessary to cause arcing between adjacent turns of the fuse element 20. This increase in the necessary dielectric breakdown voltage is commonly referred to as an increase in the creepage between adjacent turns of the fuse element.

From equations (1) and (2) and review of FIG. 2 it is determined if the width 22 (Ew) of fuse element 20 is made greater than the width 16 of cutouts 12 and the spacing 24 (Es) between the adjacent turns of the wound fuse element 20 is equal to or greater than the combined longitudinal distance of the width 16 (W) and spacing 18 (C) between adjacent cutouts 12, then at least one cutout 12 is always interposed between adjacent turns of the fuse element 20. Conforming the dimensions of cutouts 12 to the dimensions of the fuse element 20 in accordance with this relationship provides one core 10 that accommodates a wide variety of types and numbers of fuse elements 20 and is capable of accommodating a substantially unlimited number of desired spacing between adjacent turns of fuse element 20. For example, a core 10 having desired dimensions of 2.54 mm (0.1 in) and 2.54 mm (0.1 in) for width 16 and spacing 18, respectively, of cutouts 12 can accommodate a typical high voltage fuse having three elements 20 rated at 8.3 kV for carrying a current of 80 amperes and having a width of 4.75 mm (0.187 in). This same core with cutouts 12 having the width of 2.54 mm (0.1 in) and the spacing of 2.54 mm (0.1 in) also accommodates a typical 15.5 kV fuse element 20 rated for a current carrying capacity of 40 amperes and having a width of 4.75 mm (0.187 in). For each of these examples the desired adjacent element spacing may cover the wide range from 7.62 mm (0.3 in) to 12.7 mm (0.5 in), with different numbers and lengths of elements.

It should now be appreciated that conforming the cutouts 12 to the desired dimensions given in equations 1 and 2 provides a core 10 on which a wide variety of fuse elements 20 may be wound at a wide variety of desired adjacent element spacing with assurance that at least one cutout will be located between each pair of adjacent turns of fuse element 20 to thereby increase the creepage between adjacent turns.

Figure 3:
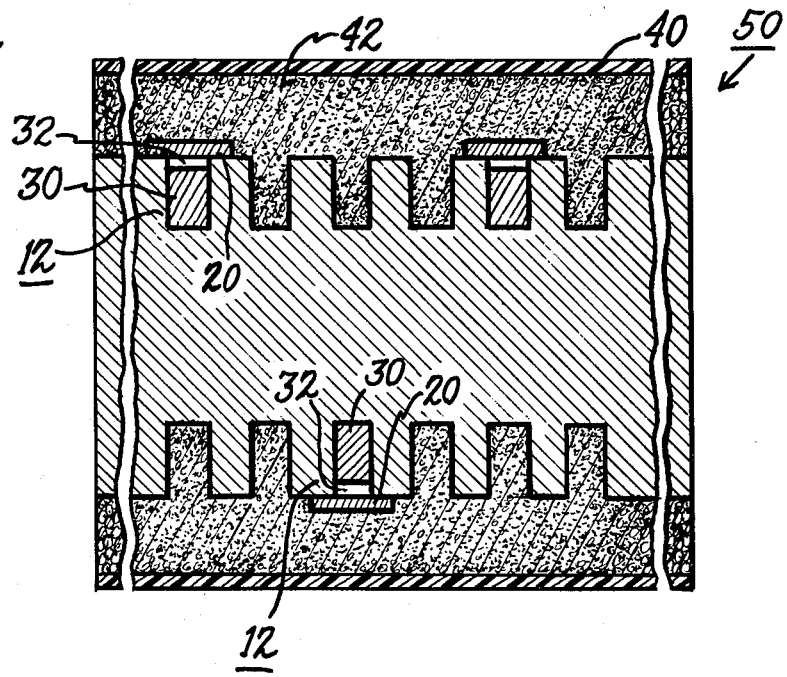
FIG. 3 is a cross sectional view of a core of the present invention enclosed in a housing, surrounded by a fuse filler substance and having a gas evolving material embedded in a portion of the cutouts of the core.

The operational performance of core 10 may be further improved by affixing a gas evolving material 30 into some of the cutouts 12 of core 10, as shown in FIG. 3. FIG. 3 shows a partial cross section of a high voltage fuse 50 having a tubular enclosed casing 40 constructed of a suitable insulating material such as glass, fiber, or glass fiber impregnated with epoxy resin. The casing 40 is filled with a body of suitable pulverant refractory arc quenching material such as quartz 42 having a preselected grain size.

The core 10 extends axially along the casing 40 and is radially spaced therefrom and is thus substantially surrounded by the quartz material 42 except for portions of cutouts 12 having the gas-evolving material 30. The gas-evolving material 30 is affixed, by a suitable means such as epoxy, into the cutouts 12 which have the fuse element 20 contacting their outer surfaces. From FIG. 3 it is seen that the fuse element 20 is separated from the gas-evolving material 30 by a gap 32 formed at the outer surface of cutouts 12.

The gas-evolving material 30 is adapted to evolve a gas in the presence of an arc. The gas evolving material 30 may be of such a composition comprised of a water-insoluble binder and an antitracking substance selected from the class consisting of the hydrates and oxides of aluminum and magnesium. The composition may also include other fillers such as mica, glass, fiber, asbestos or silica. One material suitable for the invention comprises approximately 75% aluminum hydrate filler, 20% polyester resin binder, and approximately 5% glass fiber. The active gas generated and anti-tracking ingredient may be of a commercial grade aluminum hydrate $Al(OH)_3$, magnesium hydrate $Mg(OH)_2$, an oxide of aluminum such as alumina, $Al_2O_3$ or magnesium oxide.

In one embodiment of the present invention the gap 32 is free of the quartz material 42. This freedom of quartz material 42 is realized by selecting the grain size of quartz material 42 to be greater than the dimension of gap 32. Conversely, a second embodiment of the present invention may be realized by selecting the grain size of quartz material 42 to be less than the dimension of gap 32 so as to allow the quartz material 42 to enter gap 32 and contact the gas-evolving material 30. Both of these embodiments are to be described hereinafter.

During the operating of the high voltage fuse device 50 if the current applied to the fuse element 20 exceeds the current carrying capability of the fuse element 20, the excessive current generates heat that initiates melting of the fuse element 20. When fuse element 20 is subjected to this current of fault magnitude, the fuse element 20 quickly attains fusing temperatures and vaporizes, whereby arcing occurs and the metal vapor rapidly expands to many times the volume originally occupied by the fuse element 20. These vapors are thrown into spaces between the quartz material 42 where they condense and are no longer available for current conduction. A current limiting effect results from the introduction of arc resistance into the circuit. It is desirable that the physical contact between the hot arc initiated by the melting of the fuse element 20 and the relatively cool granules cause a rapid transfer heat from the fuse element to the granules, thereby dissipating most of the arc energy with very little pressure build-up within the fuse enclosure 40.

It is also desirable that the quartz material 42 in the immediate vicinity of the arc-initiating fuse element 20 melts and absorbs arc energy. The fulgurite resulting from the fusion and sintering of the quartz sand particles is in the nature of semiconducting glass body, and as it cools it ceases to be semiconducting, becomes an insulator and thus accomplishes its desired function.

Furthermore, during the operation of fuse device 50 it is desired that the gas generated by material 30 produces a de-ionizing action on the arc produced by vaporization of the fuse element 20 as well as producing a cooling effect on the fulgurite in a manner so as to inhibit the "restriking" of the arc. By restriking it is meant the recurrence of fuse conduction after the fuse has interrupted the current. The placement of a gas evolving material 30 within cutouts 12 and the allowance of the gap 32 within cutouts 12 provides a cooling and de-ionizing gas blast when an arc is initiated adjacent to material 30.

Typically the thermal conductivity of the core 10 or gas evolving material 30 is substantially higher than that of the quartz material 42 by a ratio of about five to one. The higher thermal conductivity of core 10 or gas evolving material 30 with respect to that of the quartz material 42 provides a cooling effect which has a tendency to interfere with the desired heating of the fuse element 20 prior to its melting on overcurrents. The use of an air space between the element 20 and the gas evolving material 30 reduces the heat flow to, and cooling effect of, the core 10 and gas evolving material 30 in the period prior to fuse melting. The overall result of the reduction of the cooling effect of core 10 and gas evolving material 30 is to provide more heat to the desired locations within the fuse device 50 and therefore improve the operational performance of the high voltage device 50.

As previously discussed, a second embodiment of the present invention having the gas evolving material 30 in cutouts 12 may be provided by supplying a quartz material 42 having a grain size smaller than gap 32 such as to allow quartz material to enter the cutout 12 and contact the fuse element 20 and gas evolving material 30. The allowance of the direct contact between the quartz material 42 and the element 20 allows more of the heat emitted from fuse element 20 to be conducted to the quartz material 42. The increase in the heat conducted to the quartz material 42 improves the fulgurite effect of the quartz material while also reducing the cooling effect of core 10 and gas evolving material 30.

It should now be appreciated that the present invention provides various embodiments that introduce gas evolving material into the arcing process while reducing the cooling effect of core 10 and the gas evolving material 30 before fuse melting occurs, allowing for improved operating performance of a high voltage fuse device 50. It should also now be appreciated that the above-described dimensional relationship between the fuse element 20 and the cutouts 12 in the core 10 assures the interposition of at least one cutout 12 between adjacent turns of the fuse element 20 and therefore improves the creepage between adjacent turns of the fuse element 20.

Although most of the above description refers to a single fuse element wound on the core 10, it is to be understood that the invention is also applicable to fuses that comprise a plurality of parallel-connected fuse elements wound in spaced side-by-side relationship on the core. In such a construction, the spacing between adjacent turns is the spacing between the immediately-adjacent turns of separate fuse elements. Whether there is a single fuse element or a plurality of fuse elements, complying with equations 1 and 2 hereinabove assures that at least one cutout will be located between adjacent turns.

While I have shown and described particular embodiments of my invention, it will be obvious to those skilled in the art that various changes and modifications may be made without departing from my invention in its broader aspects; and I, therefore, intend herein to cover all such changes and modifications as fall within the true spirit and scope of my invention.

What is claimed is:

1. In a high voltage fuse of the current limiting type having a tubular insulating casing and an inert granular material of high dielectric strength within the casing, said current limiting fuse further comprising:

a core within the tubular casing extending longitudinally thereof;

one or more ribbon-type fuse elements of predetermined width wrapped around the core and having turns spaced apart along the length of said core, said core having a plurality of angularly-spaced fin members disposed about its center and extending longitudinally of the core, said plurality of fin members having a plurality of cutouts located on their outer surface so as to increase the outer surface area of said core, said cutouts having a predetermined width with immediately-adjacent cutouts being spaced apart from each other by a predetermined amount, said predetermined width of said cutout being less than the predetermined width of said fuse element, said predetermined width of said cutout and said predetermined amount of spacing between immediately-adjacent cutouts having a combined longitudinal distance along the outer surface of the associated fin member which is less than the distance along the fin member between adjacent turns of the fuse element or elements so that at least one of said cutouts is interposed between adjacent turns of said wrapped fuse element or elements, whereby said interposition of said cutout between said adjacent turns of said fuse element or elements improves the creepage between adjacent turns of said fuse element or elements.

2. A high voltage fuse of claim 1 further comprising a gas evolving material located in at least one of said cutouts and having said fuse element or elements positioned over the outer surfaces of said core at said one cutout, said gas evolving material in said one cutout occupying a major portion of said one cutout, said one cutout having a minor portion unoccupied by said gas-evolving material located between the outer surface of the gas evolving material and the portion of the fuse element positioned over said one cutout, said gas-evolving material supplying a de-ionizing gas when subjected to fuse arcing.

3. A high voltage fuse according to claim 1 wherein said minor portion of said one cutout is free of inert material.

4. A high voltage fuse according to claim 1 wherein said minor portion of said one cutout is occupied by inert filler.

* * * * *